United States Patent [19]

Greco, Jr.

[11] Patent Number: 4,873,554

[45] Date of Patent: Oct. 10, 1989

[54] ELECTROSTATOGRAPHIC MACHINE WITH WITHDRAWABLE COPY PAPER MODULE

[75] Inventor: Robert L. Greco, Jr., Penfield, N.Y.

[73] Assignee: Xerox Corporation, Stamford, Conn.

[21] Appl. No.: 213,027

[22] Filed: Jun. 29, 1988

[30] Foreign Application Priority Data

Jul. 1, 1987 [GB] United Kingdom ..... 8715481

[51] Int. Cl.[4] ..... G03G 15/00

[52] U.S. Cl. ..... 355/309; 355/200; 271/162

[58] Field of Search ..... 355/3 SH, 3 R, 3 DR, 355/23, 24, 14 SH, 72, 26; 271/162–164

[56] References Cited

U.S. PATENT DOCUMENTS

| | | | |
|---|---|---|---|
| 3,512,884 | 5/1970 | Murgas et al. | 355/84 |
| 3,698,804 | 10/1972 | Cranskens et al. | 355/3 |
| 4,017,169 | 4/1977 | Komura et al. | 355/3 R |
| 4,116,556 | 9/1978 | Tanaka et al. | 355/3 SH |
| 4,165,069 | 8/1979 | Colglazier et al. | 271/162 |
| 4,165,168 | 8/1979 | Baumann et al. | 355/3 R |
| 4,327,992 | 5/1982 | Babicz | 355/3 DR |
| 4,456,363 | 6/1984 | Hirabayashi | 355/3 R |
| 4,462,677 | 7/1984 | Onoda | 355/3 R |
| 4,470,689 | 9/1984 | Nomura et al. | 355/3 R |
| 4,531,823 | 7/1985 | Deguchi et al. | 355/3 R |
| 4,660,963 | 4/1987 | Stemmle | 355/24 |
| 4,708,468 | 11/1987 | Stemmle | 355/72 |

FOREIGN PATENT DOCUMENTS

| | | |
|---|---|---|
| 60-64366 | 4/1985 | Japan . |
| 61-56371 | 3/1986 | Japan . |

*Primary Examiner*—R. L. Moses
*Attorney, Agent, or Firm*—Mark Costello

[57] ABSTRACT

An electrostatographic machine which includes means for forming an electrostatic latent image on an imaging member; means for developing the electrostatic latent image with a developer material; means for transferring, at a transfer station, the developed image to a copy sheet; a copy sheet system for conveying copy sheets to and from the transfer station and means for fusing the developed image to the copy sheet. The copy sheet system is withdrawable from the rest of the machine as a module comprising substantially the entire path through which copy sheets are moved during operation of the machine.

3 Claims, 3 Drawing Sheets

ELECTROSTATOGRAPHIC MACHINE WITH WITHDRAWABLE COPY PAPER MODULE

This invention relates to an electrostatographic machine, for example, a xerographic copying machine. An electrostatographic machine typically comprises means for forming an electrostatic latent image on an imaging member; means for developing the electrostatic latent image with a developer material; means for transferring, at a transfer station, the developed image to a copy sheet; a copy sheet system for conveying copy sheets to and from the transfer station and means for fusing the developed image to the copy sheet.

Because a xerographic machine is a relatively complex machine, it is preferred that good accessibility is provided to its various operating stations so that, for example, the operator can easily remove copy paper sheets following a paper jam, or so that a service engineer can quickly and efficiently make any required adjustments, or repair any faults.

One form of xerographic machine of the kind set out above, and designed to allow good accessibility to its copy paper path, is described in U.S. Pat. Nos. 4,462,677 and 4,470,689. In this machine, the upper part of the machine opens relative to the lower part in 'clam-shell' fashion, the lower part containing most of the components of the copy paper path through the machine, as well as the fuser, and the upper part containing the image-forming parts of the machine, i.e. the optics and a xerographic cassette.

U.S. Pat. No. 4,531,823, to Deguchi, describes an electrostatic copying machine in which the copy paper transporting path, from the paper supply to the output tray, is divided into two units. The two units are slidably mounted for withdrawal from the body of the machine in opposite directions, from the sides of the machine.

Japanese Patent Publication No. 61-56371 discloses a copying machine in which the copy paper transport path is exposed by opening one part of the machine, relative to the main part, about a vertical hinge.

U.S. Pat. No. 4,456,363, to Hirabayashi, describes a slidably mounted subframe, in an electrophotographic copying machine, which can be pulled out of the front of the machine. The subframe carries the main process elements, including the photoreceptor.

Other copying machines having withdrawable or hinged portions are described in Japanese Patent Publication No. 60-64366, and in U.S. Pat. Nos. 3,698,804, 4,017,169; 4,116,556; 4,660,963; and 4,708,468.

The machine of the present invention is intended to provide an electrostatographic machine which has a compact, versatile and easily accessible copy paper system.

According to the present invention, there is provided an electrostatographic machine comprising a first portion including means for forming an electrostatic latent image on an imaging member; means for developing the electrostatic latent image with a developer material; and means for transferring, at a transfer station, the developed image to a copy sheet; and a second portion comprising a module which is slidably mounted at one side of the first portion directly adjacent said transfer station, the module being separable from the first portion by being pulled out of the front of the machine; the module including a copy sheet supply, a fuser for fusing developed images to the copy sheets, a copy sheet output receiver, and a copy sheet transport system for conveying copy sheets from the supply to the transfer station, from the transfer station to the fuser, and from the fuser to the output receiver.

Thus, in the machine of the invention, substantially the entire paper path system, including the fuser, is mounted on a module which is slidably withdrawable, from one side of the body of the machine, out of the front of the machine. The module may carry one or more copy sheet supply containers and one or more copy sheet output receivers. If a duplex facility is provided, the duplex tray may also be provided on the module.

An electrostatographic machine in accordance with the invention will now be described, by way of example, with reference to the accompanying drawings, in which.

Figure 1:
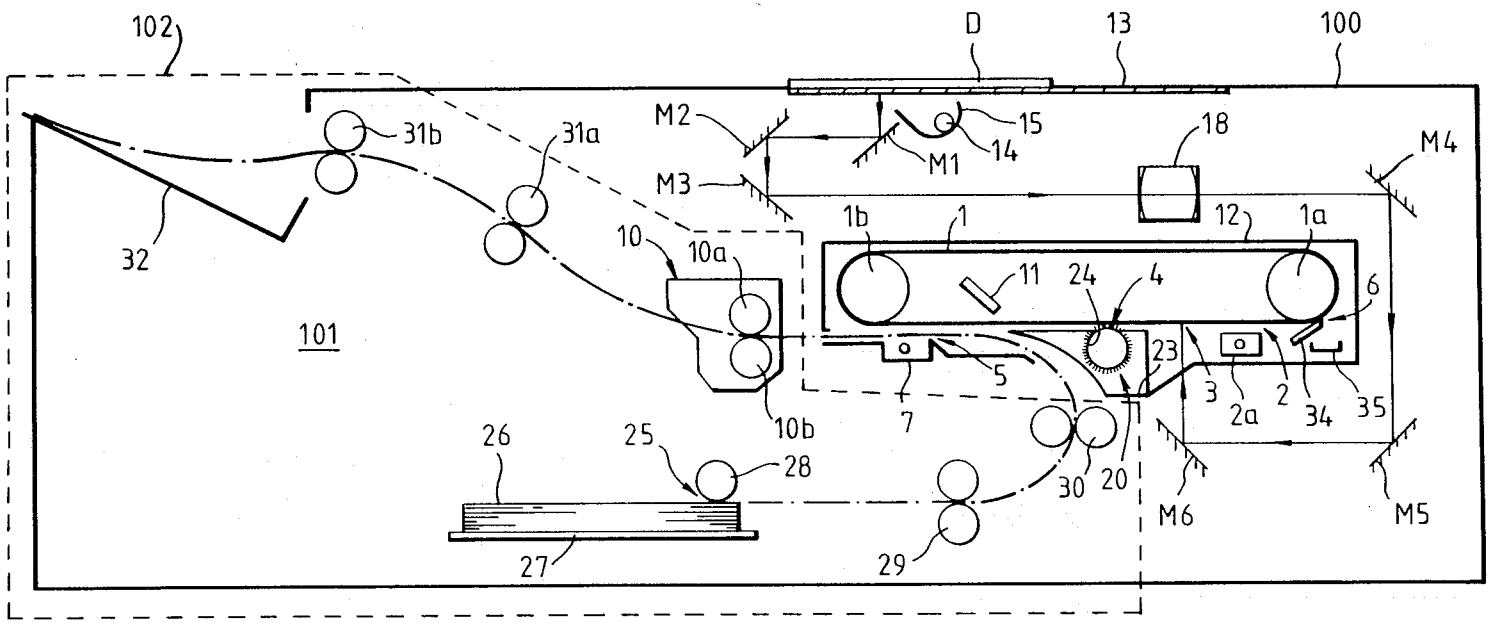
FIG. 1 is a schematic cross-section of a xerographic copying machine incorporating the invention.

Referring first to FIG. 1, there is shown schematically a xerographic copying machine incorporating the present invention. The machine includes an endless flexible photoreceptor belt 1 mounted for rotation (in the clockwise direction as shown in FIG. 1) about support rollers 1*a* and 1*b* to carry the photosensitive imaging surface of the belt 1 sequentially through a series of xerographic processing stations, namely a charging station 2, an imaging station 3, a development station 4, a transfer station 5, and a cleaning station 6.

The charging station 2 comprises a corotron 2*a* which deposits a uniform electrostatic charge on the photoreceptor belt 1.

An original document D to be reproduced is positioned on a platen 13 and is illuminated in known manner a narrow strip at a time by a light source comprising a tungsten halogen lamp 14. Light from the lamp is concentrated by an elliptical reflector 15 to cast a narrow strip of light on to the side of the original document D facing the platen 13. Document D]thus exposed is imaged on to the photoreceptor 1 via a system of mirrors M1 to M6 and a focusing lens 18. The optical image selectively discharges the photoreceptor in image configuration, whereby an electrostatic latent image of the original document is laid down on the belt surface at imaging station 3. In order to copy the whole original document the lamp 14, the reflector 15, and mirror M1 are mounted on a full rate carriage (not shown) which travels laterally at a given speed directly below the platen and thereby scans the whole document. The mirrors M2 and M3 are mounted on another carriage (not shown) which travels laterally at half the speed of the full rate carriage in order to maintain the optical path length constant. The photoreceptor 1 is also in motion whereby the image is laid down strip by strip to reproduce the whole of the original document as an image of the photoreceptor.

At the development station 4, a magnetic brush developer system 20 develops the electrostatic latent image into visible form. Here, toner is dispensed from a hopper (not shown) into developer housing 233 which contains a two-component developer mixture comprising a magnetically attractable carrier and the toner, which is deposited on the charged areas of belt 1 by a developer roller 24.

The developed image is transferred at transfer station 5 from the belt to a sheet of copy paper which is delivered into contact with the belt in synchronous relation to the image from a paper supply system 25 in which a stack of paper copy sheets 26 is stored on a tray 278. The top sheet of the stack in the tray is brought, as required, into feeding engagement with a top sheet separator/feeder 28. Sheet feeder 28 feeds the top copy sheet of the stack towards the photoreceptor around a 180° path via two sets of nip roller pairs 29 and 30. The path followed by the copy sheets is denoted by a broken line in FIG. 1. At the transfer station 5 a transfer corotron 7 provides an electric field to assist in the transfer of the toner particles to a copy sheet.

The copy sheet bearing the developed image is then stripped from the belt 1 and subsequently conveyed to a fusing station 10 which comprises a heated roller fuser to which release oil is applied. The image is fixed to the copy sheet by the heat and pressure in the nip between the two rollers 10*a* and 10*b* of the fuser. The final copy is fed by the fuser rollers into catch tray 32 via two further nip roller pairs 31*a* and 31*b*.

After transfer of the developed image from the belt some toner particles usually remain on the surface of the belt, and these are removed at the cleaning station 6 by a doctor blade 34 which scrapes residual toner from the belt. The toner particles thus removed fall into a receptacle 35 below. Also, any electrostatic charges remaining on the belt are discharged by exposure to an erase lamp 11 which provides an even distribution of light across the photoreceptor surface. The photoreceptor is then ready to be charged again by the charging corotron 2*a* as the first step in the next copy cycle.

The photoreceptor belt 1, the charge corotron 2*a*, the developer system 20, the transfer corotron 7, and the cleaning station 6 may all be incorporated in a process unit in the form of a cassette 12 adapted to be removably mounted in the main assembly 100 of the xerographic copier.

The apparatus of the invention includes a slidably withdrawable module 101 which contains substantially the entire path through which copy sheets are moved during operation of the machine. In FIG. 1, diagrammatic representations of the more important components which are carried by the module are contained within the dashed line 102. In other words, in the simplified version of the machine depicted in FIG. 1, copy paper sheets leave the copy paper supply system 25, and are conveyed to the right through roller pair 29, upwardly through roller pair 30, and into transfer station 5 of the cassette 12. Copy sheets then leave the transfer station 5, pass to the left through the fuser 10, and are fed out into catch tray 32 by roller pairs 31*a* and 31*b*. The sheets make a substantially 180° turn as they are conveyed to and through the transfer station.

Figure 2:
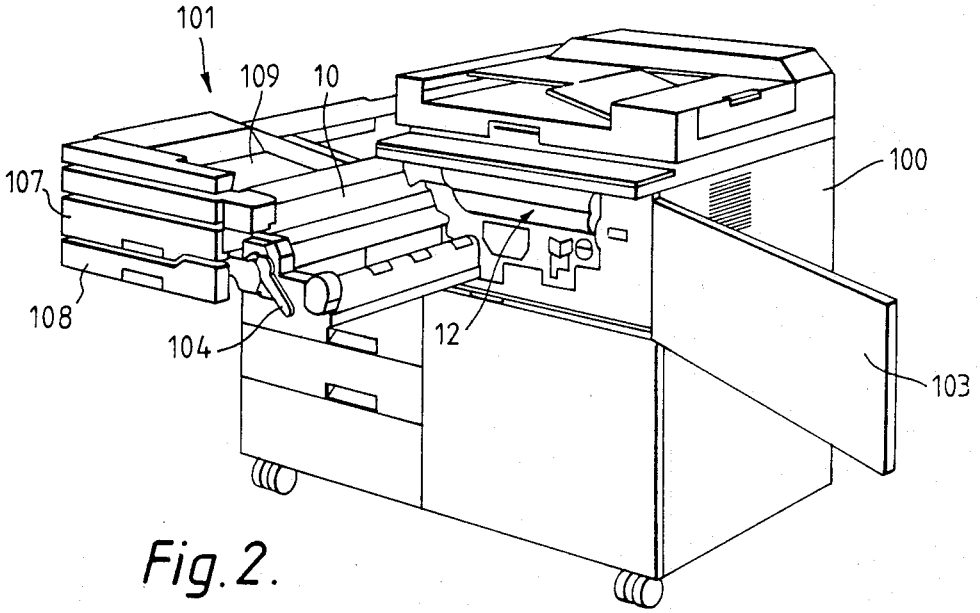
FIG. 2 is an overall perspective view of a machine incorporating the invention, showing the copy sheet system module withdrawn from the machine.
Figure 3:
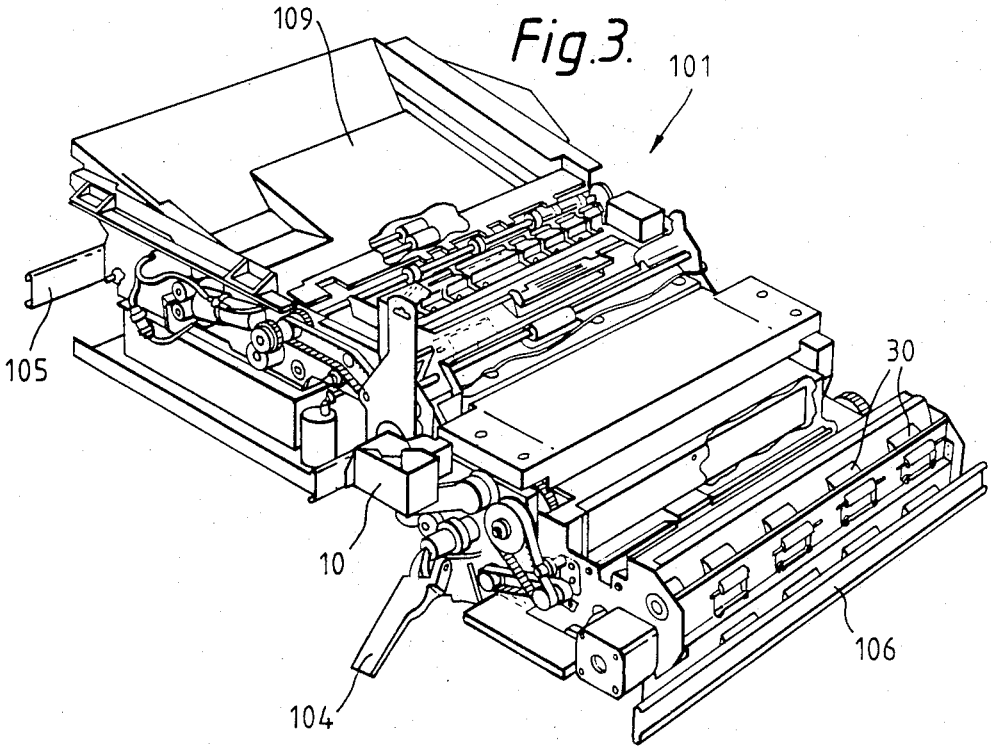
FIG. 3 is a perspective view of the module removed from the machine.

Referring now to FIG. 2, the module 101 is shown in the position in which it has been withdrawn from the main assembly 100 of the machine. After opening a front cover 103 of the machine, a handle 104 is operated to release the module, and is used to pull the module forward on slides 105, 106 (FIG. 3) to the position shown.

A main copy paper tray 107 and an auxiliary appear tray 108 are mounted on slides on the module 101, but are interlocked with the module so that they can only be withdrawn (to the front of the machine) when the module is fully inserted into its home position within the machine. Each paper tray contains a cassette, and has a built-in sheet feeder. Above the two paper trays is a manual feed tray 109, for feeding individual sheets or small stacks of sheets through the machine instead of using paper already contained in one of the sheet trays in the machine. This allows sheets of, for example, different weights or colors to be used on an occasional basis, when needed, without having to empty and refill a sheet cassette. The manual feed tray 109 also serves as an intermediate storage tray when the machine is operated in a duplex copying mode. A copy output tray (shown as catch tray 32 in FIG. 1, but omitted from FIGS. 2 and 3) is mounted above the manual feed tray 109 to receive finished copies.

Access to the whole paper path can be obtained by withdrawing the module 101. Operation of the handle 104 also releases the fuser rolls, which are normally in pressure engagement with one another. Access to the paper path is improved by releasably mounted sets of rollers and paper guides, located at suitable places around the paper path, which can be temporarily removed, or swung out of their operating positions into positions given good access.

Figure 4:
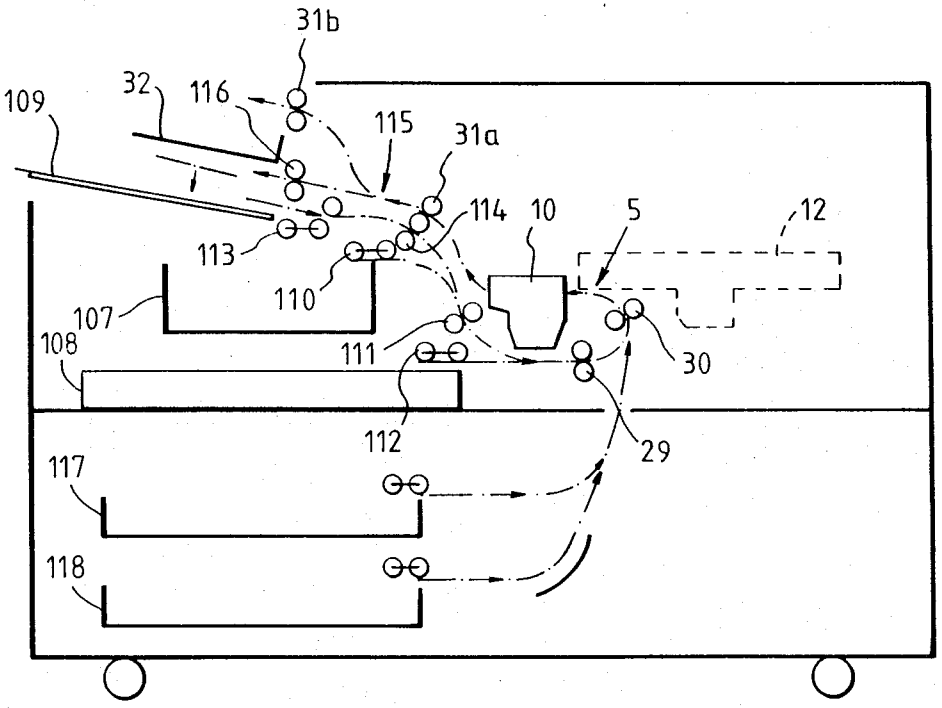
FIG. 4 is a diagrammatic cross section of the machine including the invention, showing copy sheet paths through the machine.

Referring now to FIG. 4, the copy paper sheet paths through the machine are shown by dotted lines. Starting with a simplex copy to be made on a sheet from the main tray 107, a sheet is fed out by a sheet feeder 110, and is conveyed by roller pairs 111, 29 and 30 to the transfer station 5 at the lower left hand corner of the xerographic cassette 12. From the transfer station, the sheet is conveyed through the fuser 10, through roller pairs 31*a* and 31*b*, and out in output tray 32.

If copies are to be made on sheets fed from the auxiliary tray 108, they are fed out by sheet feeder 112 directly into roller pair 29, whereafter they follow the same path as just described for sheets fed from the main tray.

When copies are to be made on sheets fed from the manual feed tray 109, they are fed by sheet feeder 113 and by roller 114 to roller pair 111, after which the path is the same as described above. Feed roller 114 cooperates with one of the rollers of roller pair 31*a* to form a roller pair for conveying sheets fed from the manual feed tray 109.

For duplex copying, a copy is made on the first side of a copy sheet, which is conveyed along one of the paths described above as far as roller pair 31*a*. Between roller pair 31*a* and roller pair 31*b*, as indicated by reference 115, a diverter is situated. This diverts copies which are to be duplex copies, but which have been imaged only on the first side, via roller pair 116 into the manual feed tray 109. The copy sheet is then re-fed, in the same fashion as described above for the manual feed tray, with its first imaged side facing initially upwards. On its second pass through the transfer station, the second side image is transferred onto the second side of the sheet, after which the sheet passes through the fuser, through roller pairs 31*a* and 31*b*, and out in the output tray 32.

Further copy paper capacity can be provided by third and fourth copy sheet trays 117 and 118 which are mounted in the base portion of the machine. Copy sheets from either of these two trays are directed to roller pair 30, after which they follow the same paths as described above.

I claim:

1. Electrostatographic machine comprising:

a first portion including means for forming an electrostatic latent image on an imaging member; means for developing the electrostatic latent image with a developer material; and means for transferring, at a transfer station, the developed image to a copy sheet; and a second portion comprising a module which is slidably mounted at one side of the first portion directly adjacent said transfer station, the module being separable from the first portion by being pulled out of the front of the machine;

the module including a copy sheet supply, a fuser for fusing developed images to the copy sheets, a copy sheet output receiver, and a copy sheet transport system for conveying copy sheets from the supply to the transfer station, from the transfer station to the fuser, and from the fuser to the output receiver.

2. The machine of claim 1, wherein the path of copy sheets through said module turns through substantially 180° between a copy sheet supply container and a copy sheet output receiver.

3. The machine of claim 1, wherein the imaging member comprises a photoconductive member within a removable cassette, and wherein the transfer station constitutes the interface between said module and the cassette.

* * * * *